United States Patent [19]

Balzer

[11] 4,112,641

[45] Sep. 12, 1978

[54] STAIR NOSING STRUCTURE

[75] Inventor: Claude P. Balzer, Wichita, Kans.

[73] Assignee: Balco, Inc., Wichita, Kans.

[21] Appl. No.: 846,153

[22] Filed: Oct. 27, 1977

[51] Int. Cl.[2] ..... E04F 11/16

[52] U.S. Cl. ..... 52/179; 52/DIG. 6

[58] Field of Search ..... 52/177, 179, 182, 188, 52/DIG. 6, 183; 24/73 B, 73 BC, 73 BP

[56] References Cited

U.S. PATENT DOCUMENTS

| | | | |
|---|---|---|---|
| 1,670,798 | 5/1928 | Connelly | 52/179 |
| 1,681,073 | 8/1928 | Welcome | 52/179 |
| 2,607,971 | 8/1952 | Bedford, Jr. | 24/73 B |
| 3,381,775 | 5/1968 | Livers | 52/182 X |
| 3,421,274 | 1/1969 | Balzer et al. | 52/179 |
| 3,512,222 | 5/1970 | Tinnerman | 24/73 B |
| 3,759,000 | 9/1973 | Balzer et al. | 52/179 |
| 4,001,991 | 1/1977 | Balzer et al. | 52/179 |
| 4,037,374 | 7/1977 | Balzer et al. | 52/179 |
| 4,043,579 | 8/1977 | Meyer | 24/73 BC |

FOREIGN PATENT DOCUMENTS

| | | | |
|---|---|---|---|
| 1,377,376 | 9/1964 | France | 24/73 B |

*Primary Examiner*—Leslie Braun

*Attorney, Agent, or Firm*—Fishburn, Gold & Litman

[57] ABSTRACT

A stair nosing structure for stair steps comprises an elongated, substantially rigid base member having an interlocking portion and a channel portion positioned along opposing longitudinal edges thereof. An elongated tread member overlies and is supported by the base member, and includes a portion matingly engaging the base member interlocking portion, and a depending rib having opposed sides thereof positioned between the faces of the channel portion. A plurality of fastening clips are disposed in the channel portion of the base member and are regularly spaced therealong. Each of the clips has a rigidly resilient body with a first portion thereof connected with one of the channel faces, and a second portion thereof frictionally engaging one of the rib sides, and securely interconnects the base and tread members.

11 Claims, 6 Drawing Figures

STAIR NOSING STRUCTURE

This invention relates to stair nosing structures for stair steps, and in particular to a stair nosing structure having fastener clips interconnecting base and tread members of the structure.

The principal objects of the present invention are: to provide a stair nosing structure for stair steps having fastening clips for securing and efficiently connecting base and tread members of the structure; to provide such a structure having mating rib and channel portions which provide a one-step assembly of the base and tread member; to provide such a structure wherein the base and tread members can be assembled without tools; to provide such a structure having interlocking members on the forward edge of the base and tread members for quick and easy assembly; to provide such a structure having a rearwardly extending lateral flange for securely connecting the base member to the stair; to provide such a structure wherein each clip is provided with a rigidly resilient body to prevent separation and/or bounce between the base and tread member; to provide such a structure wherein said clips provide unidirectional locking between the base and tread member; to provide such a structure having a downwardly curved surface at the forward edge thereof for stable attachment of the base to the stair; and to provide such a structure which is economical to manufacture, durable in use, and particularly well adapted for the proposed use.

Other objects and advantages of this invention will become apparent from the following description taken in connection with the accompanying drawing wherein are set forth, by way of illustration and example, certain embodiments of this invention.

The drawings constitute a part of this specification and include exemplary embodiments of the present invention and illustrate various objects and features thereof.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention and virtually any appropriately detailed structure.

Figure 4:
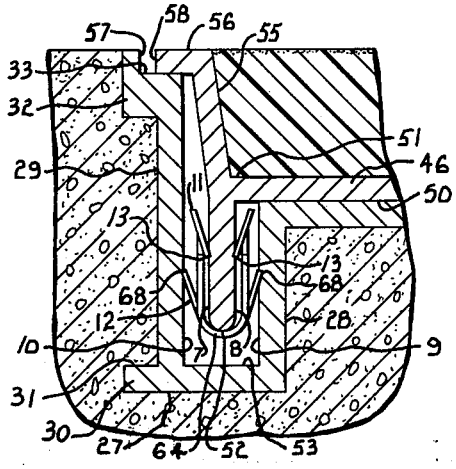
FIG. 4 is a further enlarged, fragmentary vertical cross-sectional view of the stair and stair nosing structure, particularly showing interlocking engagement between tread and base members thereof.

The reference numeral 1 generally designates a stair nosing structure embodying the present invention and comprising a base member 2 having an interlocking portion 3 and a channel portion 4 positioned along opposing, longitudinal edges thereof. A tread member 5 overlies and is supported by the base member 2, includes a forward portion 5' matingly engaging the interlocking portion 3 of the base member 2, and a depending flange or rib 6 having opposed sides 7 and 8 (FIG. 4) positioned between the interior faces 9 and 10 respectively of the channel portion 4. A plurality of fastening clips 11 are disposed in the channel portion 4 of the base member 2 and are regularly spaced therealong. Each of the clips 11 comprises a rigidly resilient body having a first portion thereof connected with one of the channel faces 9 and 10 and a second portion thereof frictionally engaging one of the rib sides 7 and 8, and interconnecting the base and tread members 2 and 5 respectively. In the structure illustrated in FIGS. 1 to 4 inclusive, each of the clips 11 has first and second pairs of sharp resilient edges 12 and 13 respectively which frictionally engage the channel faces 9 and 10 and the rib sides 7 and 8 respectively, and securely interconnect the base member 2 with the tread member 5.

The base member 2 is an elongated, substantially rigid structure and is shaped for positioning the same in unsolidified cementious material, such as concrete, from which the stair step is preferably constructed. To facilitate description, the terms forward, rearward, upper, lower, and the like, shall be related to the structure as oriented in FIGS. 1 and 2, however, it is to be understood, that the structure may assume various alternative orientations. The illustrated base member 2 comprises a bottom panel 17 (FIG. 2) having a substantially flat upper surface, a channel portion 14 disposed rearwardly of the bottom panel 17, and a recessed portion 18 positioned forwardly of the bottom panel. The lower surface 19 of the bottom channel panel 17 is also substantially flat, and in this example, includes an anchor portion 20 depending therefrom for mounting the base member 2 to the stair step 21. The illustrated anchor portion 20 includes a pair downwardly extending flanges 22 having opposing, inwardly turned ends 23 which are spaced apart at predetermined distance and form a C-shaped channel which is adapted to receive an elongate anchor bolt 24 therein.

The channel portion 4 comprises a base 27, and forwardly and rearwardly upstanding side walls 28 and 29 respectively connected therewith. The upper end of the forward side wall 28 is integrally formed with the rearward edge of the bottom panel 17. A transverse flange 30 extends rearwardly of the rear side wall 29 along the base 27, and provides a shoulder or lip 31 for securely anchoring the base member 2 in the concrete step 21. The upper end of the rearward side wall 29 includes a rearwardly projecting portion 32 having a recessed shoulder area 33 extending along the length of the side wall 29. The channel side walls 28 and 29 include interior faces 9 and 10 respectively which are preferably flat and smooth, and are spaced apart a predetermined distance for receiving the fastening clips 11 therein with an interference fit.

The recessed portion 18 of the base member 2 is positioned forwardly of the bottom panel 17 and includes a base 35, and forward and rearward end walls 36 and 37 respectively. In the illustrated structure, the base 35 has a substantially flat upper surface which is spaced below and parallel with the upper surface of bottom panel 17. The forward end wall 36 of the recessed portion is inclined rearwardly from the bottom edge 38 to the top edge 39, and the top surface 40 is substantially coplanar with the upper surface of the bottom panel 17. The illustrated top edge 39 is rounded to facilitate assembly of the base and tread members. The lower surface 41 of the base 35 includes an arcuately shaped portion 42 disposed at the forward edge thereof, and curved downwardly. The forwardmost surface 43 of the base member 2 is preferably flat and positioned in a coplanar relationship with the outside surface of the vertical riser portion 44 of the step 21.

The tread member 5 is elongated and substantially rigid, and preferably has a two part construction including a base plate 46, and a non-slip tread surface 47 affixed thereto by means such as bonding or the like. A plurality of longitudinally extending and rearwardly inclined ribs 48 project from the upper surface 49 of the base plate 46 to facilitate the secure connection of the tread surface 47 to the base plate 46. The lower surface 50 of the base plate 46 is substantially flat, and a medial portion thereof overlies and is supported by the upper surface of the bottom panel 17. The rib 6 is integrally connected with and depends from the rearward edge 51 of the base plate 46. The rib 6 is positioned centrally between the interior faces 9 and 10 of the channel side walls 28 and 29, and an end edge 52 thereof is spaced apart from the bottom surface 53 of the base 27. The exterior surfaces 7 and 8 of the rib 6 are preferably flat and smooth. An end flange 55 projects upwardly in the base plate 46 at the rear edge 51 thereof, and is integral with the rib member 6. The end flange 55 is inclined slightly rearwardly from the bottom edge to the top edge thereof, and includes a rearwardly directed portion 56 at the upper edge thereof. The lower surface of the portion 56 abuts and overlies the shoulder 32 on the base member 2, and is supported thereby. The free end edges 57 and 58 (FIG. 4) of portions 32 and 56 respectively are spaced apart slightly and provide a slot into which a tool may be received for removing or replacing the tread member 5.

The forward end of the tread member includes a downwardly extending flange 59 (FIG. 2), which integrally interconnected with the base plate 46 along the forward edge thereof. The flange 59 includes an inclined forward surface 60 which is shaped to mate with the recess end wall 36 and forms a wedge-shaped joint for interconnecting the base and tread member along the forward edges thereof. The bottom surface 61 of the flange 58 abuts the recess base 35, and a forwardly extending tongue 62 of the base plate 46 abuts and is supported by the top surface 40 of the recess forward end wall 36. The base member 2 and the tread member 5 are each preferably of an integral construction, and are particularly adapted to be formed of extrusions of metal, such as aluminum, brass, and the like. Such materials are relatively soft, and co-operatively engage with the sharp clip edges for secure interconnection.

Each of the fastening clips 11 (FIG. 3) comprises a substantially U-shaped body 63 having a bight or base 64 with opposed, upstanding side walls 65 and 66. A pair of first engaging edges 12 are provided at the medial portion of the clip body 63, and each includes a V-shaped free edge 67 which projects outwardly of the associated clip side wall and includes an apex 68 orientated away from the clip base 64. The apex 68 is quite sharp, and is adapted to gouge or cut into the associated interior surface 9 and 10 of the channel side walls 28 and 29 respectively. In the illustrated example, the edge 67 is formed by slitting associated portions of the clip side wall and bending that portion outwardly. The retaining member 12 is therefore in the form of a flap or tab which is resiliently flexible at the free edge 67, and the bottom of the same is integrally attached to the clip base 64, thereby permitting downward translation of the clip 11 into the channel portion 4, but preventing or resisting relative translation in the reverse or opposite direction. The clip side walls 65 and 66 each include a pair of end edges 71 and 72 respectively. Each end edge has an inwardly projecting cut or slit 73 adjacent an upper portion thereof, and defines upper and lower portions 74 and 75 of each end edge. The upper portion 74 of each of the end edges is bent inwardly, is sharp, and forms edge pairs 13 which frictionally engage the associated surfaces of 7 and 8 of the rib 6, thereby permitting downward translation of the rib into the clip, yet preventing or resisting relative translation in the reverse direction.

In use, the anchor bolts 24 are first connected in the mating C-shaped channel 22, and positioned in spaced apart relation along the length of the base member 2. The base member 2 and attached anchor bolts 24 are then set in the unsolidified cement of the stair step 21, making sure that the forward surface 43 of the base member is coplanar with the riser surface 44 of the step, and the uppermost surface 78 of the rearward flange 32 is coplanar with the upper surface of the stair step 21. The cement is cured, whereby the anchor bolts 24, along with the flanges 30 and 42 securely anchor the base member 2 in the stair step 21. The tread plate 46 and tread surface 47 are preferably preassembled and cut to length in accordance with the base member 2. The fastening clips 11 are preferably assembled, at least part way, onto the tread member rib 6. The outwardly bent upper ends 74 of the clips facilitate insertion of the clips onto the rib 6, whereby edges 13 gouge or bite into rib surfaces 7 and 8 respectively to connect the clip thereto. The clips 11 are placed in a regularly spaced relation along the rib 6, at intervals in the nature of 12 to 18 inches apart. It is to be understood that as an alternative means of assembly the clips may be similarly positioned in the channel portion 4 of the base member.

Figure 1:
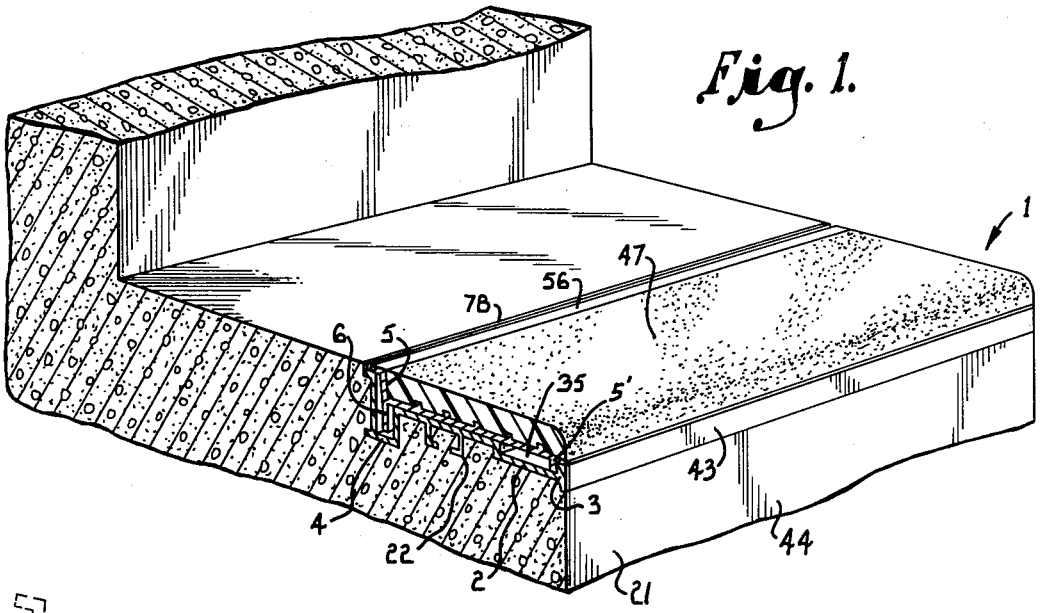
FIG. 1 is a fragmentary perspective view of a stair nosing structure embodying the present invention, being shown in place on a stair step with portions thereof broken away to reveal internal construction.
Figure 2:
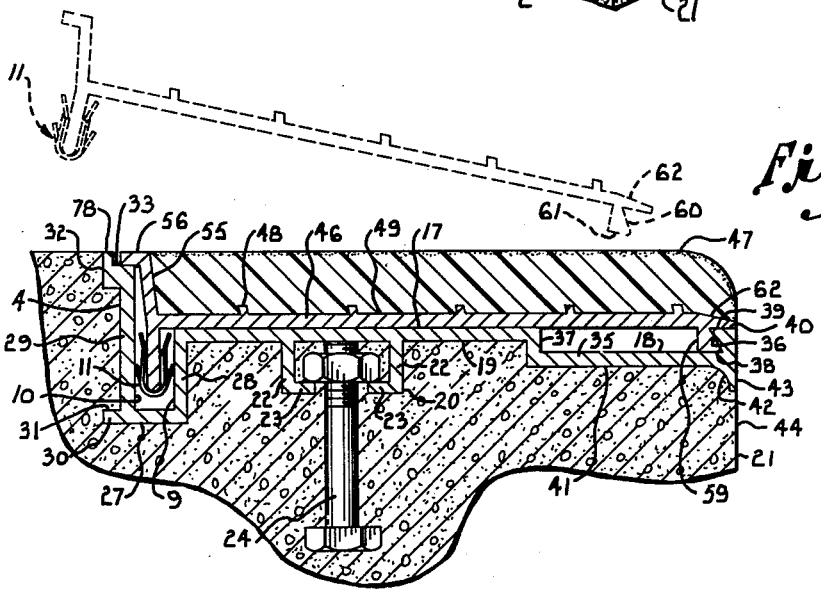
FIG. 2 is an enlarged vertical cross-sectional view of the stair step and stair nosing structure, wherein a tread member thereof, disposed in an initial mounting position, is shown in broken lines.
Figure 3:
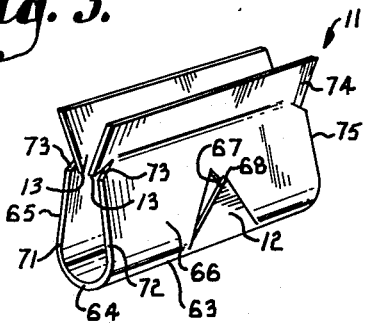
FIG. 3 is a further enlarged perspective view of a fastener clip member of the stair nosing structure.

Next, the forward edge of the tread member 5 is oriented downwardly as illustrated by the broken lines in FIG. 2. The forward depending flange 59 of the tread member 5 is positioned abutting the forward end wall 36 of the recess portion 35. The tread member 5 is then rotated downwardly (counterclockwise as oriented in FIG. 2), whereby the protuberances 12 of each of the clips 11 gouge into and frictionally engage the interior surfaces 9 and 10 of the channel portion 4 and prevent or resist upward, relative translation therebetween, thereby attaching the tread member 5 to the base member 2. The forward, inclined surfaces 36 and 60 prevent relative vertical translation of the forward portion of the tread member. The clips 11 in conjunction with interlocking surfaces 36 and 60 securely interconnect the base and tread members without requiring tools. Further, the tread member 4 may be non-destructively removed from the base member 2 for repair or replacement, by carefully prying upwardly along the rear edge 58 of the tread member. Repositioning and/or replacement of the clips 11 before reassembly provides secure interlocking.

Figure 5:
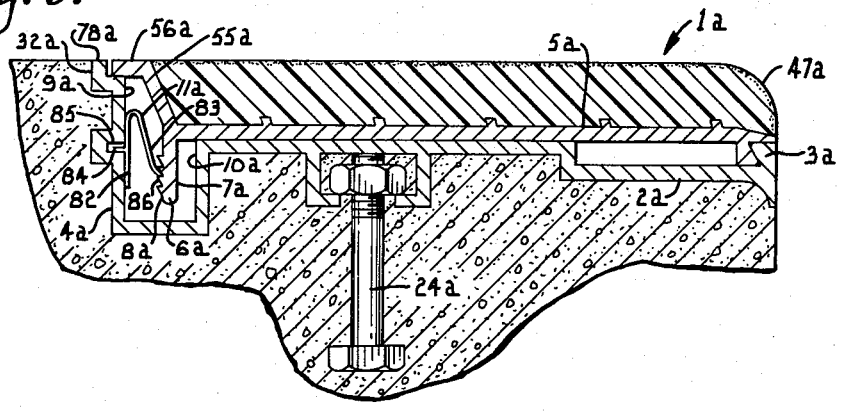
FIG. 5 is an enlarged vertical cross-sectional view of another embodiment of the present invention having a V-shaped fastener clip.

The reference numeral 1a generally designates another embodiment of the stair nosing structure (FIG. 5) having a V-shaped fastener clip 11a. Since the stair nosing structure 1a is otherwise quite similar to the previously described stair nosing structure 1, similar parts appearing in FIGS. 1 through 4 and 5 respectively are represented by the same, corresponding reference numeral, except for the suffix "*a*" in the numerals of the latter, unless designated otherwise. Unlike the U-shaped clips 11, of the first described embodiment, the present clip 11a is V-shaped having a pair of integrally formed legs 82 and 83 in the nature of a hair spring. A laterally extending support ridge 84 is connected with and extends rearwardly of the spring leg 82, and frictionally connects the clip 11a in a channel 85 formed in the inner channel surface 9a. The clip leg 83 includes a free edge which extends forwardly of the rear channel wall, and frictionally and resiliently engages the surface 8a of the rib 6a. In this example, a plurality of outwardly extending protuberances 86 are disposed on the rib surface 8a and cooperate with the clip free edge to securely anchor the tread member 5a in the base member 2a. In the orientation illustrated in FIG. 5, the clip 11a urges the tread member 5a forwardly so as to insure engagement between the inner locking portions 3a of the tread and base members.

Figure 6:
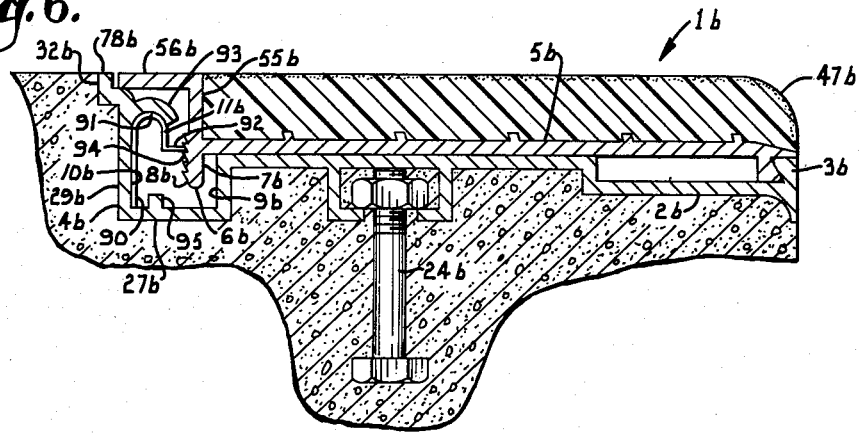
FIG. 6 is an enlarged vertical cross-sectional view of yet another embodiment of the present invention having a hook shaped fastener clip.

The reference numeral 1b generally designates yet another embodiment of the present invention (FIG. 6) having a hook shaped clip 11b. Since the stair nosing structure 1b is otherwise quite similar to the first described stair nosing structure 1, similar parts appearing in FIGS. 1 through 4 and 6 respectively are represented by the same, corresponding reference numeral, except for the suffix "*b*" in the numerals of the latter, unless designated otherwise. The illustrated clip 11b includes a straight, back portion 90 with an arcuately shaped upper end 91, and a laterally extending free end 92 which is adapted to resiliently and frictionally engage the rearward surface 8b of the rib 6b. In this example, the rear channel side wall 29b includes an arcuately shaped portion 93 which extends forwardly thereof and conforms to the curved portion 91 of the clip, and securely retains the clip 11b within the base member 2b. Also, an upwardly extending ridge 95 is provided along the base of the channel 27b and retains the clip base 90 securely against the rearward wall 10b of the channel. In this example, a plurality of protuberances 94 are provided on the rib surface 8b and extend rearwardly therefrom and cooperate with the clip free end 92 to securely retain the tread member 5b in the base member 2b. In a manner similar to the last described embodiment of the present invention, the clip 11b urges the tread member 5b forwardly, and thereby secures the interlocking forward members 3b.

It is to be understood that while I have illustrated and described certain forms of my invention, it is not to be limited to the specific form or arrangement of parts herein described and shown.

What is claimed and desired to secure by Letters Patent is:

1. A stair nosing structure for stair steps comprising:

(a) an elongated, substantially rigid base member having forward and rearward longitudinal edges, and including:

(1) an anchor portion for mounting said base member on a stair step;

(2) an interlocking portion disposed adjacent one of said forward and rearward edges;

(3) a channel portion having opposing faces and being disposed adjacent the other of said forward and rearward edges and extending therealong;

(b) an elongated tread member overlying said base member, being supported thereby, and including:

(1) an interlocking portion matingly engaging the interlocking portion of said base member and preventing relative vertical translation therebetween;

(2) a depending rib having opposed surfaces disposed between and spaced from the opposing faces of said channel portion; and (c) a plurality of fastening clips disposed in the channel portion of said base member in spaced relation therealong; each of said clips being bent from one piece of rigidly resilient sheet metal to form a channel shaped body having a first portion thereof with tongues extending therefrom and engaging a face of the channel of the base member facing the interlocking portions of the base member and tread member and a second portion with tongues engaging the rib surface adjacent said engaged channel face, said depending rib of the tread member compressing said clips in said channel portion of the base member and increasing the engagement between the tongues and rib surface and channel face to resist removal of the rib from said channel portions, the resiliency of the compressed clips urging the mating interlocking portions of the base member and tread member together for cooperation with the engagement of said clip tongues with the rib and base member channel face in retaining the tread member on the base member.

2. A stair nosing structure as set forth in claim 1 wherein:

(a) said interlocking portion of the base member is disposed adjacent said forward edge thereof; and (b) said channel portion of said base member is disposed adjacent said rearward edge thereof.

3. A stair nosing structure as set forth in claim 2 wherein:

(a) said interlocking portion of said base member includes a recessed portion extending along the forward edge thereof and having a rearwardly facing end wall inclined upwardly toward the rearward edge of said base member; and (b) said interlocking portion of said tread member includes a downwardly protruding flange extending along the forward edge thereof; said flange having an inclined forward surface mating with and abutting the rearwardly facing end wall of said base member recessed portion and forming a wedge-shaped joint for interconnecting the base member and tread member along the forward edge of each.

4. A stair nosing structure as set forth in claim 2 wherein:

(a) said channel portion of the base member comprises a base wall, and forward and rearward side walls upstanding therefrom; and (b) said channel portion rearward side wall has a laterally extending flange protruding rearwardly therefrom adjacent said base wall and forming an anchor for said base member in said stair step.

5. A stair nosing structure as set forth in claim 1 wherein:

(a) said one portion of each of said clips has a rigidly resilient free edge engaging said rib surface.

6. A stair nosing structure as set forth in claim 5 wherein:

(a) said rib surface includes protuberances thereon engaging said clip one portion.

7. A stair nosing structure for a stair step having a tread surface, said stair nosing structure comprising:

(a) an elongated relatively rigid base member adapted to be mounted on a stair step, said base member having forward and rear edge portions and upwardly facing portions and a lower face, said base member having an anchor portion adapted to be secured to the stair step, said base member having wall portions defining a channel extending along the length thereof in depending relation to said upwardly facing portion, said channel presenting opposed side faces;

(b) an elongated tread member having forward and rear edge portions and overlying said base member, said tread member having downwardly facing surfaces engaging upwardly facing portions of the base member, said tread member having a depending rib adjacent said rear edge thereof and extending into said channel, said rib having opposed side surfaces spaced from respective opposed faces of said channel;

(c) elongated interlocking portions on the base member and tread member and extending along the length thereof adjacent forward edges thereof, said interlocking portion on the base member extending upwardly and rearwardly and having a rearwardly opening recess extending along the length thereof and receiving therein the interlocking portion of said tread member for retaining the forward edge portion of the tread member engaged with the forward edge portion of the base member; and (d) a plurality of fastening clips disposed in said channel of the base member in spaced relation therealong, each of said clips being bent from one piece of rigidly resilient sheet metal to form a channel shaped body having a bight and spaced upstanding side walls with the rib of the base member received therebetween, said clips having upwardly and outwardly directed tongues with sharp edges engaging the side faces of the channel and downwardly and inwardly directed tongues with sharp edges engaging said opposed side surfaces of the rib of said tread member, said clips being compressed between said rib side surfaces and channel side faces whereby the resiliency of said clip provides an engagement of said tongues with the channel side faces and rib side surfaces to resist removal of the rib from said channel and cooperate with the interlocking portions adjacent the forward edge of the base and tread members to retain said tread member on the base member.

8. A stair nosing structure as set forth in claim 7 wherein:

(a) each of said clips has first and second pairs of sharp, resilient tongues with edges frictionally engaging the channel portion opposed side faces and rib side surfaces respectively, and interconnecting said base member and tread member.

9. A stair nosing structure as set forth in claim 8 wherein each of said fastening clips comprises:

(a) said substantially U-shaped body and bight with said upstanding side walls having a pair of end edges, and a medial portion;

(b) a first engaging tongue comprising a U-shaped free edge projecting outwardly at the medial portion thereof, and having an apex oriented away from said bight; said apex being sharp and gouging into an associated one of said channel portion side faces.

10. A stair nosing structure as set forth in claim 9 wherein:

(a) said first tongue is attached to said clip body along the base thereof, and is resiliently flexible for permitting downward translation of said clip into said channel portion, and resisting relative translation in the reverse direction.

11. A stair nosing structure as set forth in claim 9 wherein:

(a) said end edges each include an inwardly projecting slit disposed adjacent an upper portion thereof which defines upper and lower portions of said end edges; and (b) said upper portion of each of saic end edges is bent inwardly, is sharp, and frictionally engages the opposed side surfaces of said rib thereby permitting downward translation of said rib into said clip between the side walls thereof, and resisting relative translation in the reverse direction.

* * * * *